US011970361B2

(12) United States Patent
Couchey et al.

(10) Patent No.: US 11,970,361 B2
(45) Date of Patent: Apr. 30, 2024

(54) CORE WITH CUSHION STRIP AND VARYING SLOT DEPTH

(71) Applicant: Sonoco Development, Inc., Hartsville, SC (US)

(72) Inventors: Brian P. Couchey, Inman, SC (US); John Wrenn, Greenville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 18/076,000

(22) Filed: Dec. 6, 2022

(65) Prior Publication Data

US 2023/0095152 A1 Mar. 30, 2023

Related U.S. Application Data

(63) Continuation of application No. 17/150,281, filed on Jan. 15, 2021, now Pat. No. 11,661,305, which is a (Continued)

(51) Int. Cl.
*B65H 75/28* (2006.01)
*B65H 18/28* (2006.01)
(Continued)

(52) U.S. Cl.
CPC ..... *B65H 75/28* (2013.01); *B65H 18/28* (2013.01); *B65H 19/28* (2013.01); *B65H 75/00* (2013.01);
(Continued)

(58) Field of Classification Search
CPC ..... B65H 75/00; B65H 75/02; B65H 75/08; B65H 75/10; B65H 75/18; B65H 75/22;
(Continued)

(56) References Cited

U.S. PATENT DOCUMENTS 2,585,999 A 2/1952 Bunch
4,697,757 A 10/1987 Nakaya et al.
(Continued)

FOREIGN PATENT DOCUMENTS

EP 3059196 A1 8/2016
JP 2010-179989 A 8/2010
WO 2017006526 A1 1/2017

OTHER PUBLICATIONS

WO2017/006526A1 Translation; Inoue, Yoshihide; "Winding Core And Method For Winding Web Member"; Published: Jan. 12, 2017; Published By: WIPO/Espacenet (Year: 2017).*
(Continued)

*Primary Examiner* — Michael R Mansen
*Assistant Examiner* — Raveen J Dias
(74) *Attorney, Agent, or Firm* — von Briesen & Roper, s.c.

(57) ABSTRACT

A core for winding sheet material is proved. The core comprises a cylindrical tube having a longitudinally oriented slot formed therein, and a strip of soft material located in the slot. Because of the geometry of the slot and the strip, the strip may be softer (less compressed) in the central region but firmer where the core transitions from the relatively soft strip to the relatively hard tube. The leading edge of the sheet material imbeds itself into the soft central region of the strip as additional layers are wound around the core.

17 Claims, 8 Drawing Sheets

Related U.S. Application Data continuation of application No. 16/601,823, filed on Oct. 15, 2019, now Pat. No. 10,906,769, which is a continuation of application No. 15/273,885, filed on Oct. 12, 2016, now Pat. No. 10,472,201.

(51) Int. Cl.

| | |
|---|---|
| ***B65H 19/28*** | (2006.01) |
| ***B65H 75/00*** | (2006.01) |
| ***B65H 75/02*** | (2006.01) |
| ***B65H 75/10*** | (2006.01) |

(52) U.S. Cl.

CPC ..... *B65H 75/02* (2013.01); *B65H 75/10* (2013.01); *B65H 19/283* (2013.01)

(58) Field of Classification Search

CPC .... B65H 75/2218; B65H 75/26; B65H 75/28; B65H 75/38; B65H 18/28; B65H 19/28; B65H 19/283; B65H 19/286; B65H 55/00; B65H 65/00; B65H 65/005; B65H 2301/41427; B65H 2301/41428; B65H 2301/414222

USPC ..... 242/613, 613.1, 610, 610.4, 610.6

See application file for complete search history.

(56) References Cited

U.S. PATENT DOCUMENTS

| | | | | |
|---|---|---|---|---|
| 4,760,972 | A | 8/1988 | Sasaki et al. | |
| RE33,060 | E | 9/1989 | Cunningham et al. | |
| 5,286,614 | A | 2/1994 | Ishizaki et al. | |
| 5,441,212 | A | 8/1995 | Dicken et al. | |
| 5,514,429 | A | 5/1996 | Kamihgaraguchi et al. | |
| 5,601,243 | A * | 2/1997 | Inagaki | B65H 19/28 242/582 |
| 5,646,090 | A | 7/1997 | Tamura et al. | |
| 5,908,173 | A | 6/1999 | De Roeck | |
| 6,443,387 | B1 * | 9/2002 | Mercer | B65H 19/283 242/532.3 |
| 7,562,842 | B2 | 7/2009 | Ishikawa | |
| 7,712,700 | B2 | 5/2010 | Mcfarland et al. | |
| 9,290,348 | B2 | 3/2016 | Newhouse et al. | |
| 10,029,882 | B2 | 7/2018 | Newhouse et al. | |
| 10,472,201 | B2 | 11/2019 | Couchey et al. | |
| 10,611,599 | B1 * | 4/2020 | Staley | B63B 34/50 |
| 10,633,214 | B2 | 4/2020 | Qian | |
| 10,894,682 | B2 * | 1/2021 | Carver | B65B 63/04 |
| 10,906,769 | B2 * | 2/2021 | Couchey | B65H 75/02 |
| 11,661,305 | B2 * | 5/2023 | Couchey | B65H 75/02 242/613 |
| 2002/0027179 | A1 * | 3/2002 | Fujiwara | B65H 19/28 242/532.3 |
| 2002/0190152 | A1 * | 12/2002 | Haraikawa | B65H 18/28 242/608 |
| 2009/0054219 | A1 | 2/2009 | Wu | |
| 2009/0087600 | A1 * | 4/2009 | McFarland | B65H 75/10 428/34.2 |
| 2009/0289143 | A1 * | 11/2009 | Tanaka | B65H 19/2276 242/581 |
| 2013/0248643 | A1 | 9/2013 | Newhouse et al. | |
| 2015/0274483 | A1 * | 10/2015 | Newhouse | B65H 18/28 242/613 |
| 2018/0099835 | A1 * | 4/2018 | Couchey | B65H 18/28 |
| 2018/0111777 | A1 * | 4/2018 | Carver | B65B 63/04 |
| 2019/0233250 | A1 * | 8/2019 | Qian | B65H 75/28 |
| 2019/0330002 | A1 * | 10/2019 | Carver | B65H 19/283 |
| 2020/0039782 | A1 * | 2/2020 | Couchey | B65H 18/28 |
| 2021/0139268 | A1 * | 5/2021 | Couchey | B65H 19/28 |

OTHER PUBLICATIONS

JP2010179989 (A) Translation; Giyokawa et al; Sheet Winding Roller and Method for Manufacturing the Same; Published: Aug. 19, 2010; Espacenet (Year: 2010).

Raveen J. Dias, "Notice of References Cited", Jul. 21, 2020.

* cited by examiner

CORE WITH CUSHION STRIP AND VARYING SLOT DEPTH

CROSS REFERENCE TO RELATED APPLICATION

This application is a continuation of U.S. application Ser. No. 17/150,281, filed Jan. 15, 2021, which is a continuation of U.S. application Ser. No. 16/601,823, filed Oct. 15, 2019 (now U.S. Pat. No. 10,906,769), which is a continuation of U.S. application Ser. No. 15/273,885, filed Oct. 12, 2016 (now U.S. Pat. No. 10,472,201). U.S. application Ser. Nos. 17/150,281 and 16/601,823 and 15/273,885 are incorporated herein by reference in their entirety to provide continuity of disclosure.

BACKGROUND OF THE INVENTION

Field of the Invention

This disclosure relates to a core for winding sheet material thereon. More particularly, this disclosure relates to a core having a soft region in which the leading edge of a sheet can imbed itself as additional layers are wound around the core.

Description of the Related Art

Cores are used to wind sheet or strand material. However, many cores do not provide a starting area for the sheet material to compensate for the thickness of the sheet material. Upon winding a first layer of sheet material around the core, the next layers are wound over the leading edge, which can result in a line or mark on the sheet where it overlaps the leading edge.

The present disclosure is designed to solve the problems described above.

BRIEF SUMMARY OF THE INVENTION

The present disclosure generally relates to a core for winding sheet material thereon. The core is made from a tube having a longitudinally oriented slot for accommodating one or more strips of relatively soft material. Because of the geometry of the slot and the strips, the strip in the middle may be less dense where cushioning is needed but more dense where the core transitions from the relatively soft strips to the relatively hard tube.

DETAILED DESCRIPTION OF THE INVENTION

Figure 1:
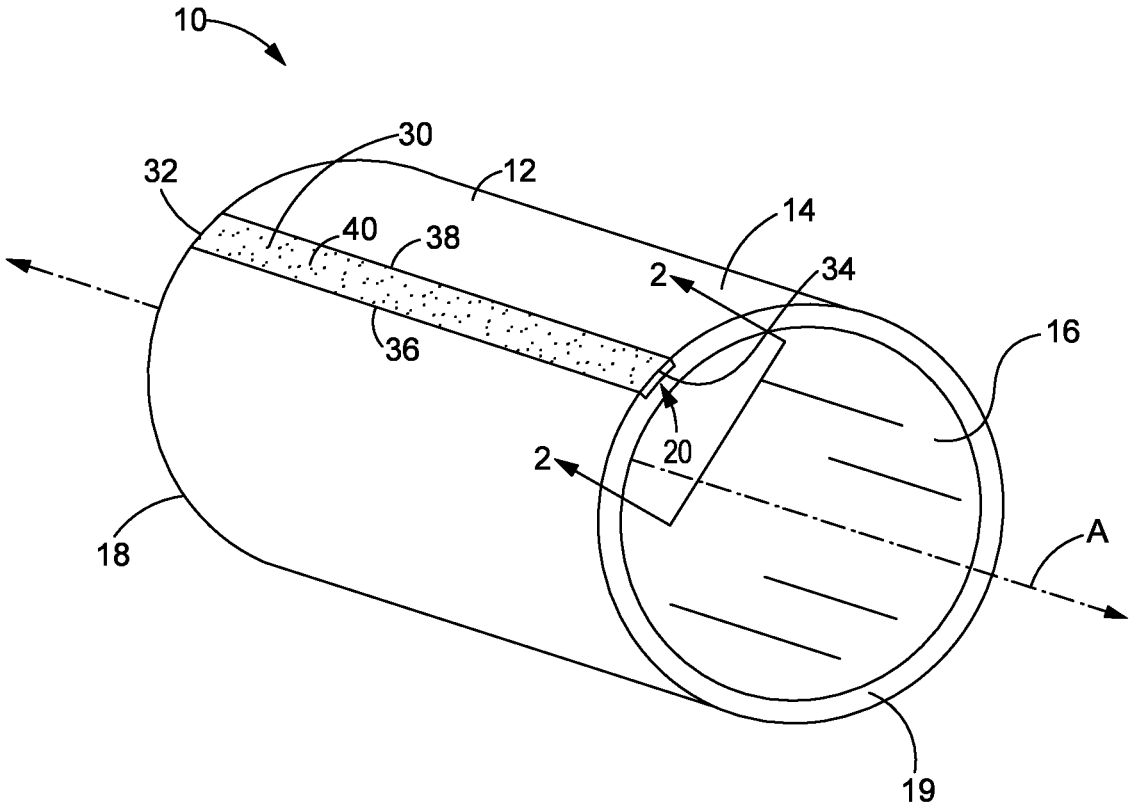
FIG. 1 is a perspective view of a core according to the disclosure, the core comprising a tube and a strip of soft material located in a slot defined by the tube.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "top" and "bottom," (etc.), used as nouns, adjectives or adverbs refer in this description to the orientation of the structure of the core as it is illustrated in the various views. Such terms are not intended to limit the invention to a particular orientation.

Turning to the drawings, where like numerals indicate like (but not necessarily identical) elements, FIG. 1 is a perspective view of a core 10 according to the disclosure. The core 10 is configured for winding sheet or strand material, and comprises a tube 12 and a strip 30 of material.

The tube 12 may be hollow and has a length, an inner diameter (ID), an outer diameter (OD) and a central longitudinal axis (A). The tube 12 has an outer facing surface 14 and an inner facing surface 16. The tube 12 has a first annular end 18 and a second annular end 19.

The tube 12 may be any suitable length, with 12 inches to 95 inches being a typical range. A typical OD may be 6.688 inches (radius of curvature=3.344 inches), and a typical ID may be 6.028 inches (radius of curvature=3.014 inches). A typical radial thickness (OD−ID) may be 0.330 inches.

The tube 12 defines a longitudinally oriented slot 20 (best shown in FIG. 2) extending the length of the tube 12 substantially parallel to the axis A and configured to accommodate the strip 30. The slot 20 may be any suitable depth, shape and width. Various exemplary slots are provided in the figures and described below.

All or most of the strip 30 may be disposed within the slot 20. The strip 30 may be any suitable shape, including one having a rectangular cross-section.

Figure 10:
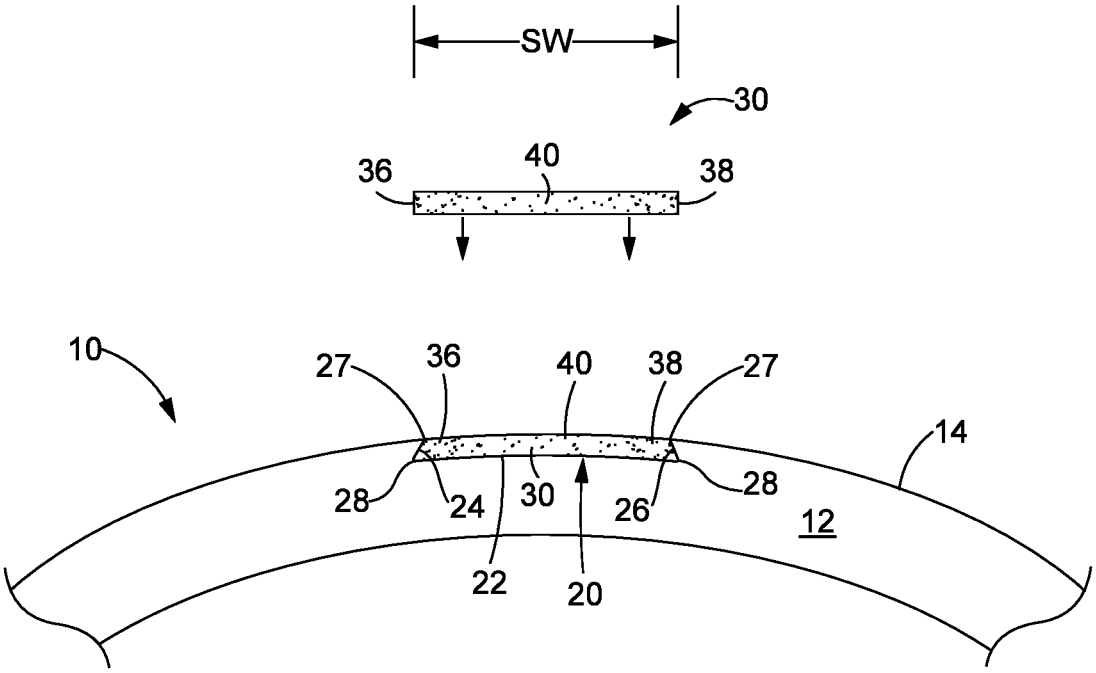
FIG. 10 is a cross-sectional view of the tube of FIG. 6 and a cushion strip before and after the strip is installed into the slot.

The strip 30 has a first annular end 32 aligned with the first annular end 18 of the tube 12 and a second annular end 34 aligned with the second annular end 19 of the tube 12. The strip 30 has a length substantially the same as the tube length. The strip 30 has a longitudinal leading side edge 36 and a longitudinal trailing side edge 38. Referring to FIG. 10, the strip 30 has a strip width (SW) which is the distance between the leading side edge 36 and the trailing side edge 38. The strip 30 has a longitudinally oriented center region 40 extending the length of the strip 30 between the leading side edge 36 and the trailing side edge 38.

Preferably the strip 30 is made of a soft resilient material, such as a foam or rubber material. As a result, the leading edge 92 of the wound sheet 90 can imbed itself the strip 30 when subsequent layers are wound. The subsequent layers apply inward pressure on the leading edge 92, causing the leading edge 92 to sink into the strip 30, which provides a smoother winding surface for subsequent layers and thus minimizes or eliminates the line or mark often found on these layers.

Preferably the installed strip 30 is softer along its center region 40 than near the leading and trailing side edges 36, 38. This is because, when a sheet 90 is wound around a tube 12 having a soft foam strip 30, the transition from foam to hard plastic can create a line or mark on the sheet. Therefore it is desirable to have a more gradual transition from soft foam to hard plastic. This is accomplished by providing a strip 30 of soft material that is softer (for example, less dense) in the center region 40 and less soft (for example, more dense) along the longitudinal edges 36, 38 of the strip where it abuts the hard tube 12. The various ways for accomplishing this difference in softness are described below.

Figure 2:
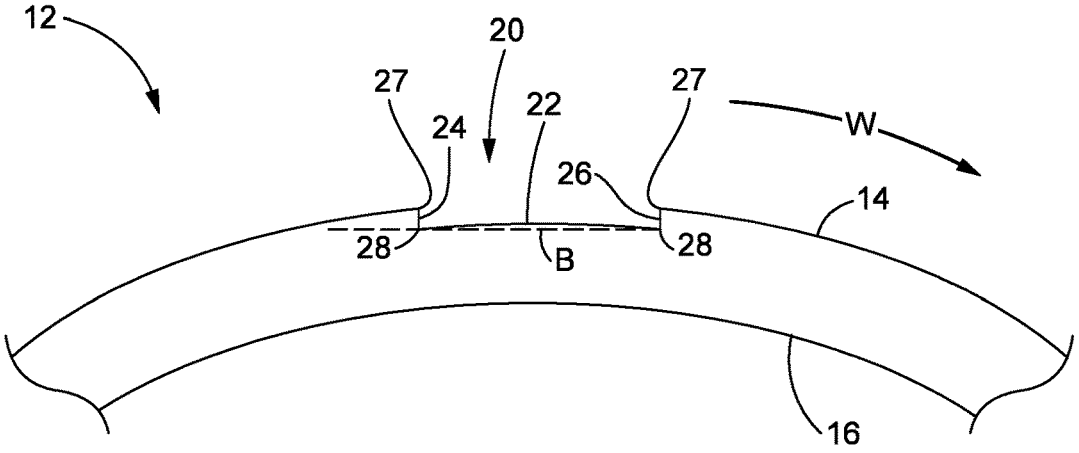
FIG. 2 is a cross-sectional view of the tube of FIG. 1 taken along line 2-2, showing a close up view of the slot in the core.

FIG. 2 is a cross-sectional view of the core 10 of FIG. 1 taken along line 2-2, showing a close up view of the slot 20 with the strip 30 removed for clarity. As noted above, the slot 20 runs the length of the tube 12. The slot 20 is defined by a bottom wall 22, a first sidewall 24 and a second sidewall 26. In the figures it is assumed that the sheet material is wound around the core 10 clockwise, in the direction of arrow (W) in FIG. 2. Thus, the first sidewall 24 of the slot 20 may be referred to as the "leading" sidewall 24 and the second sidewall 26 may be referred to as the "trailing" sidewall.

In FIG. 2 the bottom wall 22 is annular, that is, the bottom wall 22 defines the arc of a circle. In this example the outer facing surface 14 of the tube 12 and the bottom wall 22 are concentric.

Each sidewall 24, 26 extends from a top edge 27 to a bottom edge 28. In this example the sidewalls 24, 26 are parallel to each other, with each sidewall 24, 26 defining a plane perpendicular to a plane (B) intersecting the entire bottom edges 28.

The following are sample dimensions of the tube 12 and slot 20: The outer facing surface of the tube 12 has a radius of curvature of 3.344 inches and the inner facing surface of the tube 12 has a radius of curvature of 3.014 inches. The bottom wall 22 has a radius of curvature 3.288 inches. The depth of the slot 20 is a constant (3.344−3.288=0.056 inches, or $^{56}/_{1000}$th inch). The width of the slot 20 is 0.750 inches and is constant along its length and its height.

Figure 3:
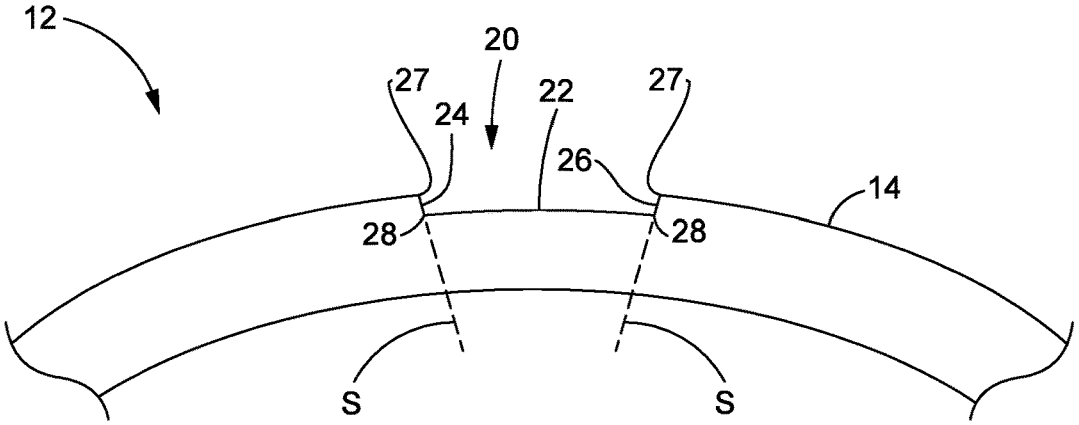
FIG. 3 is a cross-sectional view of a tube having an alternative slot.

The slot 20 of FIG. 3 is similar to the slot 20 of FIG. 2 except that the sidewalls 34, 36 are not parallel but rather taper slightly inward toward each other in the radially inward direction. In this example, each of the slot sidewalls 24, 26 defines a radially oriented plane (S), i.e., a plane that intersects the entire central longitudinal axis (A). As a result, the upper width of the slot 20 (width at the outer facing surface 14) is greater than the lower width of the slot 20 (width at the bottom wall 22). In other words, the slot 20 width decreases in the radial dimension from the outer facing surface 14 ("upper width") to the bottom wall 22 ("lower width"). As a result, for a strip 30 having a rectangular cross-section like the strip shown in FIG. 10, the strip 30 will be slightly compressed near its side edge 36, 38 when it is inserted into the slot 20.

Figure 4:
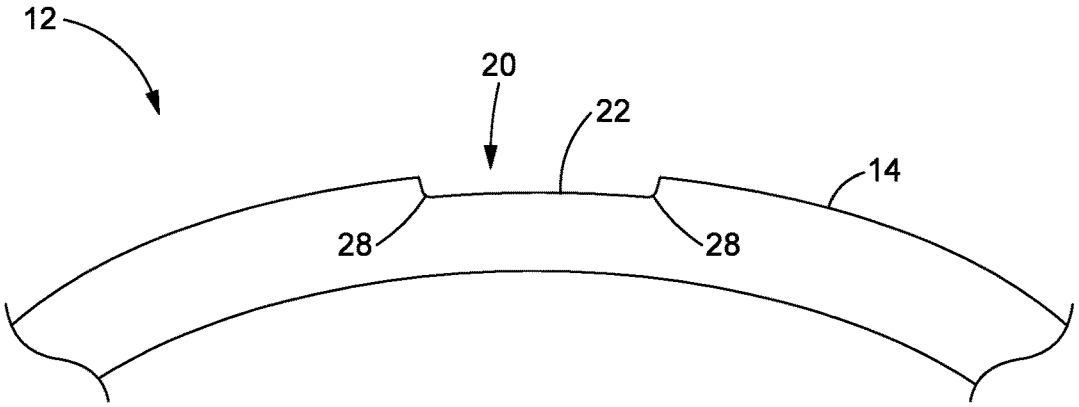
FIG. 4 is a cross-sectional view of a tube having an alternative slot.

The slot 20 of FIG. 4 is similar to the slot 20 of FIG. 3 except that the bottom edges 28 are rounded. These edges 28 may have any suitable radius of curvature, such as 0.010 inches. The rounded bottom edges 28 further compress (densify) the strip 30 slightly along the side edges 34, 36. The bottom wall 22 is annular and may have a radius of curvature of 3.288 inches. The slot 20 may be 0.056 inches deep.

Figure 5:
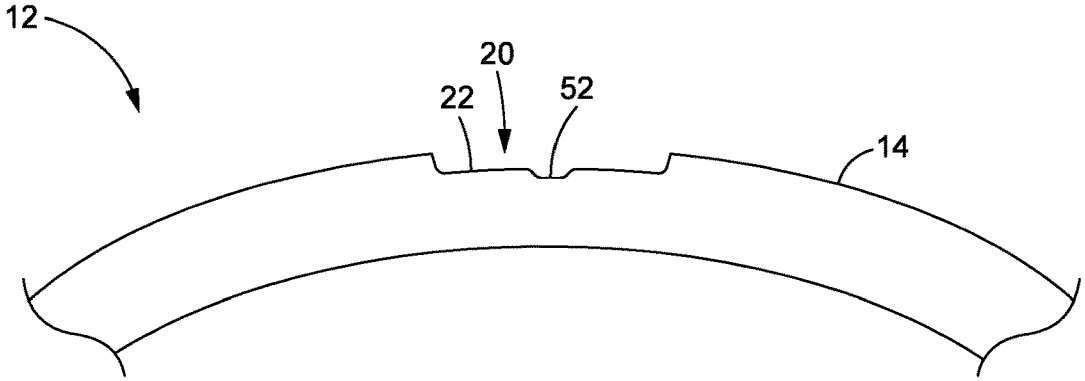
FIG. 5 is a cross-sectional view of a tube having an alternative slot.

The slot 20 of FIG. 5 is similar to the slot 20 of FIG. 4 except the tube 12 defines a longitudinally oriented dip 52 located between the bottom edges 28. In other words, the bottom wall 22 includes a centrally disposed dip 52. The slot depth is constant everywhere except along the dip 52. For example, the depth of the slot 20 may be 0.041 inches everywhere except along the dip 52, where the depth may be about 0.071 inches. This dip 52 allows the strip 30 to depress further, rendering it softer in its central region 40.

Figure 6:
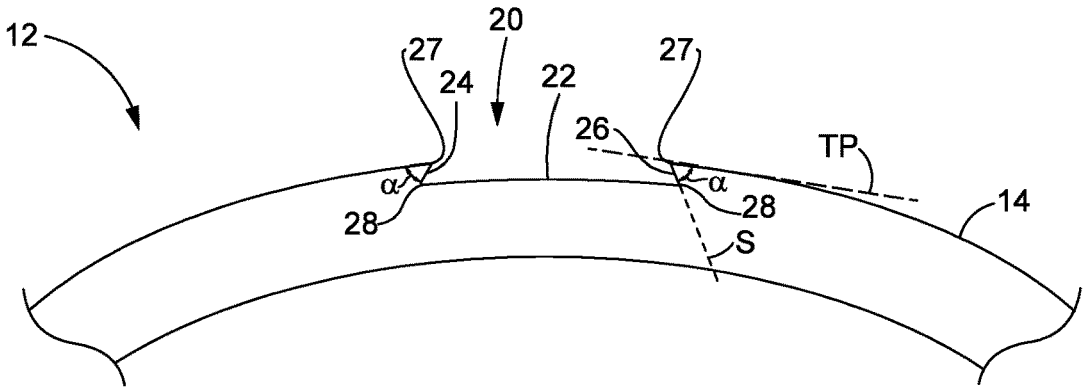
FIG. 6 is a cross-sectional view of a tube having an alternative slot.

FIG. 6 is a cross-sectional view of a tube 12 having an alternative slot 20. The bottom edges 28 of the slot 20 are rounded as in FIGS. 4 and 5. However, the sidewalls 24, 26 form a dovetail shape, that is, they splay away from each other in the radially inward direction. The upper width of the slot 20 (the distance between the top edges 27) is smaller than the lower width (the distance between the bottom edges 28). For example, the upper width may be 0.719 inches and the lower width may be 0.750 inches. The plane (S) of each sidewall 24, 26 may form an acute included angle ($\alpha$) with a plane (TP) tangential to the outer facing surface 14 of the tube 12 at the top edge 27.

As a result of this dovetail shape, the strip 30 may be even more compressed at its side edges 34, 36 when inserted into the slot 20 than in previous examples. This increased compression of the strip 30 results in a higher density of foam at the edges 36, 38, which helps the foam strip 30 resist inward pressure from the pre-load force exerted on it by a sheet 90. This in turn provides a smoother transition from the soft foam strip 30 to the hard tube 12.

Figure 7:
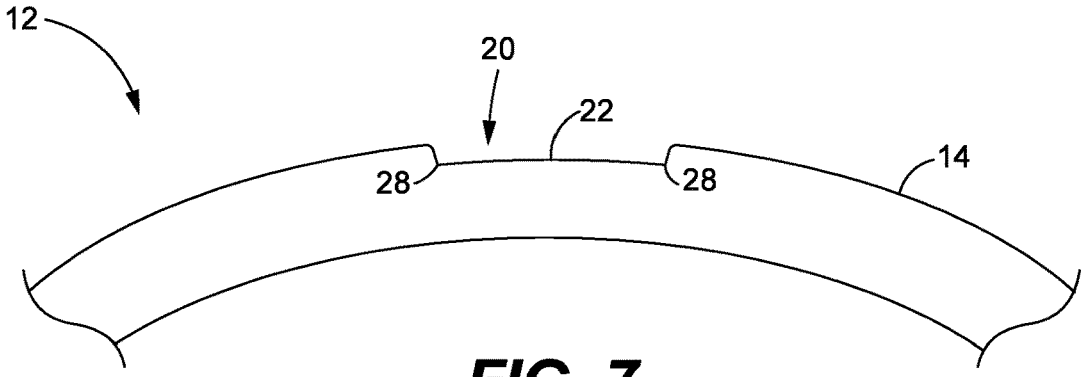
FIG. 7 is a cross-sectional view of a tube having an alternative slot.

FIG. 7 is a cross-sectional view of a tube 12 having an alternative slot 20. The bottom edges 28 of the slot are rounded and the bottom wall is annular as in previous examples. However, the bottom wall 22 has a relatively much larger radius of curvature (for example, 12.738 inches versus 3.288 inches in FIG. 4) than in previous examples, and thus appears almost flat in the figure. This near "flatness" causes the center region 40 of a foam strip 30 to be softer (weaker) than, in, say FIG. 4, because the center region 40 of the strip 30 is not as compressed. The strip edges 34, 36 will be preloaded (compressed) but there will be less preloading of the strip 30 in the central region 40 than in FIG. 4.

Figure 8:
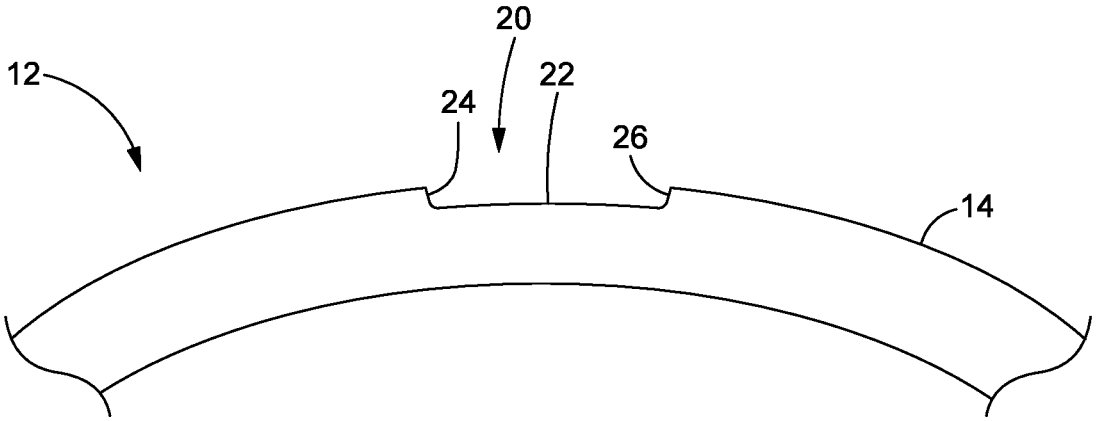
FIG. 8 is a cross-sectional view of a tube having an alternative slot.

The slot 20 of FIG. 8 is similar to the slot 20 of FIG. 4 except that the bottom wall 22 has a larger radius, for example, 3.294 inches versus 3.288 inches in FIG. 4, while the outer facing surface 14 of the tube 12 has the same radius as in FIG. 4. As a result, the slot 20 is shallower than in FIG. 4. For example, the slot 20 of FIG. 8 may have a depth of 0.050 inches versus 0.056 inches in FIG. 4. If used with the same thickness strip 30 as might be used in FIG. 4, say, a strip 30 having a thickness (T) of 0.056 inches, this shallower depth will result in the strip 30 "sticking out" (extending above) the outer facing surface 14 of the tube 12, similar to the core 10 shown in FIG. 9.

Figure 9:
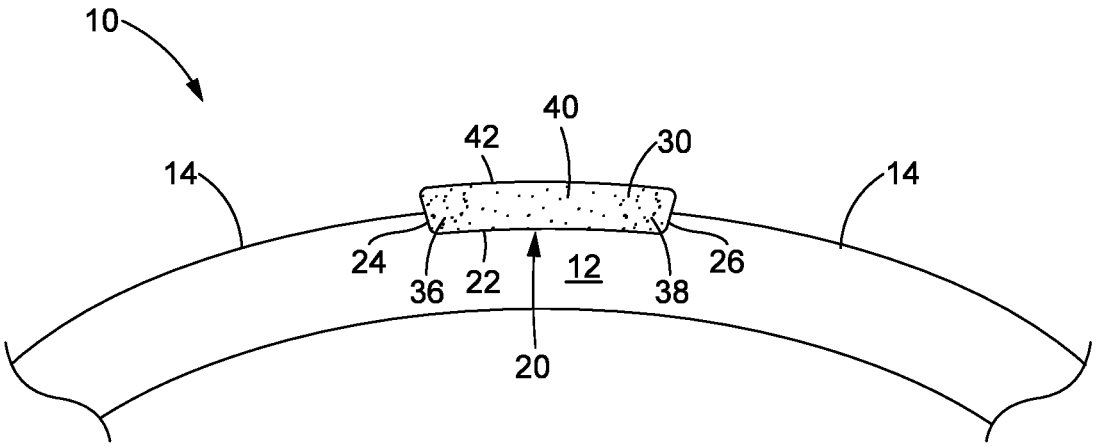
FIG. 9 is a cross-sectional view of a core.

FIG. 9 is a cross-sectional view of the tube 12 of FIG. 8 with a strip 30 having a thickness (T) exceeding the depth of the slot 20. Since the slot 20 is shallower than the thickness of the strip 30, the top surface 42 of the strip 30 extends above the outer facing surface 14 of the tube 12.

A strip 30 having a thickness (T) greater than the depth of the slot 20 may be used with any slot 20 described herein.

As a result, winding a sheet of material 90 over the core 10 will cause a greater pre-load (inward pressure) on the strip 30.

In addition to being deeper (thicker) than the slot 20, the installed strip 30 preferably is less dense along the center region 40 than along the side edges 36, 38. This variation in density across the width (SW) of the strip 30 may be the result of one or more factors explained herein and especially with respect to FIG. 11, including the geometry of the slot 20 and that of the strip 30.

FIG. 10 is a cross-sectional view of a core 10 and a strip 30 before and after the strip 30 is installed into the slot 20. The slot 20 is similar to the slot 20 of FIG. 6 in that is has a dovetail cross-sectional shape. As noted above, the purpose of the dovetail shape is to increase the density of the foam strip 30 near its edges 34, 36, and thus provide firmer support near the edges 34, 36 for the wound sheet 90. The splaying of the slot's leading edge 24 and trailing edge 26 also may eliminate the need for applying adhesive to the edges 34, 36 of the strip 30. In the figure, the strip 30 has a width (SW) substantially the same as the lower width of the slot 20 but less than the upper width of the slot 20.

Figure 11:
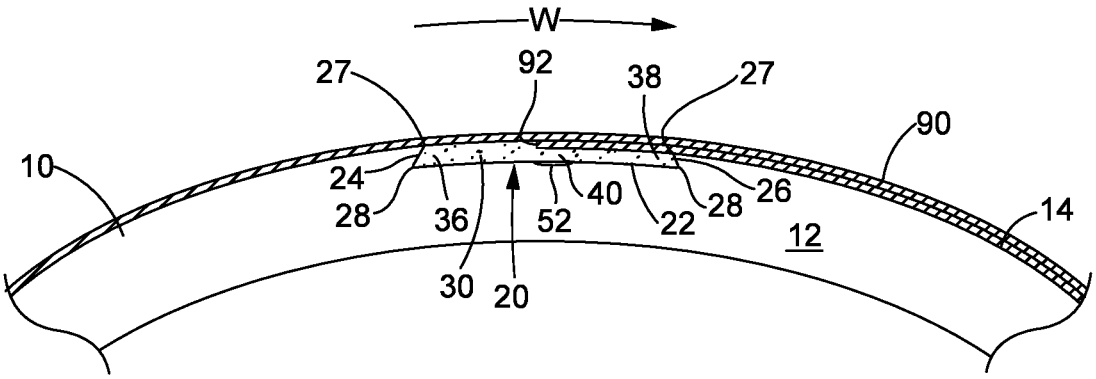
FIG. 11 is a cross-sectional view of a core and the first two layers of a wound sheet.

FIG. 11 is a close up cross-sectional view of a core 10 showing a sheet of material 90 wrapped around the tube 12. The strip 30 comprises a less dense central region 40 interposed between more dense regions near the leading edge 36 and trailing edge 38.

The leading edge 92 of the sheet 90 is overlies the less dense central region 40 of the strip 30. As the sheet 90 is wound around the tube 12, the sheet 90 exerts inward pressure on the underlying layer of sheet material 90, including the leading edge 92. In response, the leading edge 92 imbeds itself into the strip 30, providing a smoother substrate for subsequent layers of the sheet 90. This allows the sheet 90 to be wound smoothly around the core 10 without leaving lines or other imperfections on the wound sheet 90.

Even where the strip 30 abuts the relatively harder tube 12 along the top edges 27 of the slot 20, the relatively higher density of the foam strip 30 along these side edges 34, 36 helps support the sheet 90, mitigating or preventing damage to the sheet 90 along the longitudinal regions where the core 10 transitions between the soft strip 30 and the hard tube 12.

This example illustrates a number of potentially advantageous features:

1. Dovetailed slot: The dovetailed sides 24, 26 increase the density of the strip along its side regions 34, 36 and thus helps support the sheet 90 along these side regions 34, 36. The dovetail shape may also eliminate the need to adhere the strip 30 to the bottom wall 22 along the strip edges 34, 36 as explained further below.
2. Depression in bottom wall: The centrally located dip 52 in the bottom wall 22 provides a lower durometer in this region which helps the leading edge 92 to sink into the strip 30.
3. Strip width: Using a strip 30 that is wider than the upper width or even the lower width of the slot 20 helps density the strip 30, especially at the side edges 34, 36.
4. Strip thickness greater than slot depth: Having the slot depth less than the thickness of the foam strip 30 provides a "preload" compression on the strip 30 when the sheet is first wound.
5. Rounded bottom edges: The rounded bottom edges 28 may help densify the side regions 34, 36 of the strip 30.

Any or all of these features have the potential advantage of minimizing or eliminating the line or mark that sometimes appears on the first number of layers of a wound sheet 90.

Method of Making a Core

Figure 12:
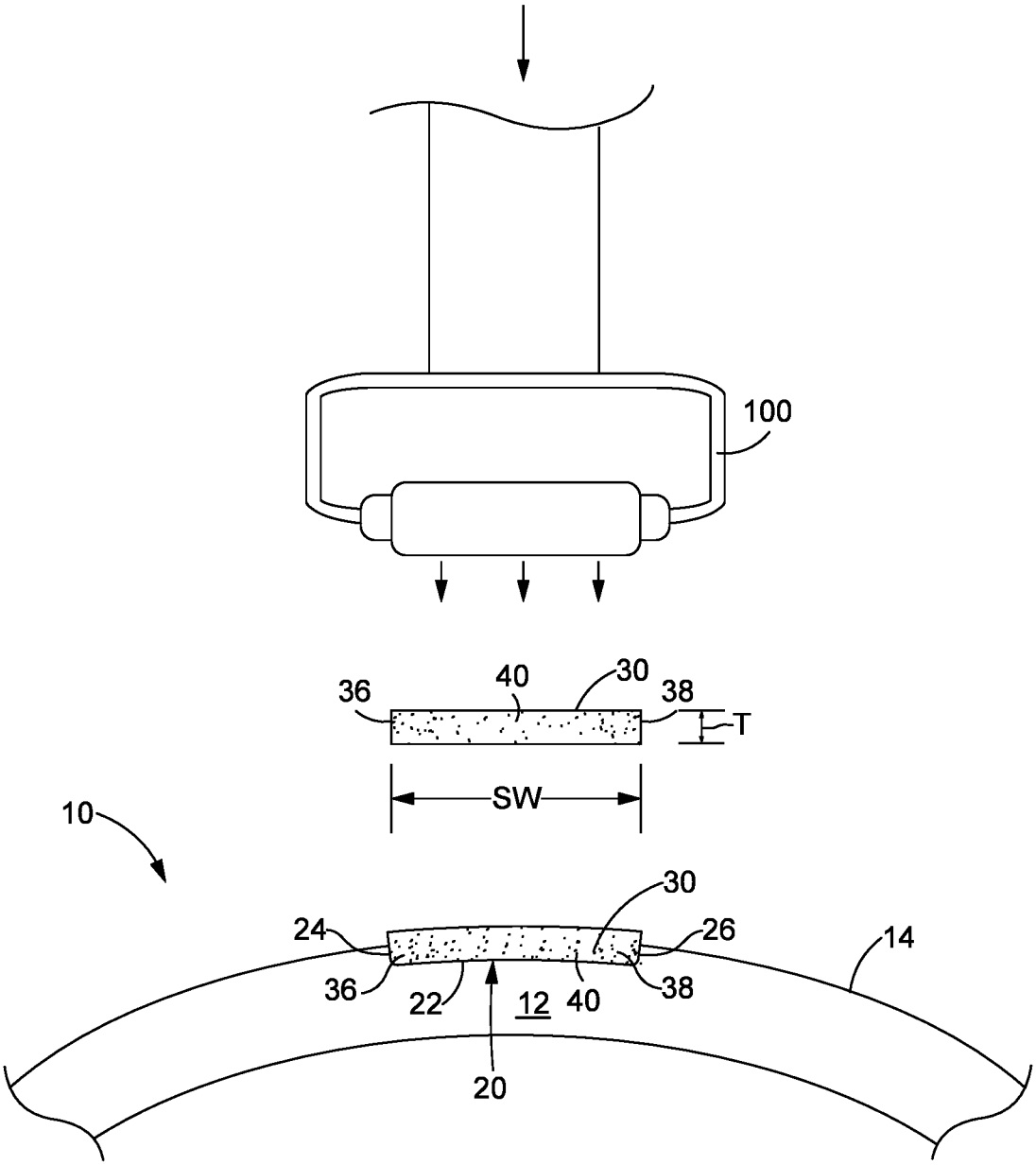
FIG. 12 is a schematic showing a method of installing a strip into a slot.

FIG. 12 is a schematic showing one way to make a core 10. The core 10 may be made according to the following steps:

Step 1: Provide a tube 12. The tube 12 may be made of a hard material such as plastic.

Step 2: Mill a slot 20 into the tube 12. The slot 20 may have any of the features described herein.

Step 3: Provide a strip 30 of cushioning material. The strip 30 may have a rectangular cross sectional shape and have a thickness (T) and a width (SW). The thickness (T) may be equal to or greater than the depth of the slot 20. The width (SW) of the strip 30 may be equal to or greater than the upper width and/or lower width of the slot 20. For example, the strip 30 may have a thickness (T) of, say, 0.065 inches while the slot has a depth of 0.056 inches and the strip 30 may have a width (SW) of 0.850 inches while the slot 20 has an upper width and a lower width of 0.750 inches.

Step 4: Using a roller 100, push the strip 30 into the slot 20. First, the roller 100 may push the center region 40 of the strip 30 into the slot 20, where it may be adhered to the bottom wall 22 with glue or other adhesive that has been previously applied to the slot 20 or to the strip 30, then the side edges 36, 38 of the strip 30 may be pushed into place, in essence, "tucking" or squeezing the edges 34, 36 of the strip 30 into the slot 20.

This process leaves the foam cells near the center region 40 of the strip 30 less compressed, with less pressure applied to the center of the strip by the roller(s) 100. The resulting strip 30 has a higher density near the edges 34, 36 and a lower density along the center region 40.

Figure 13:
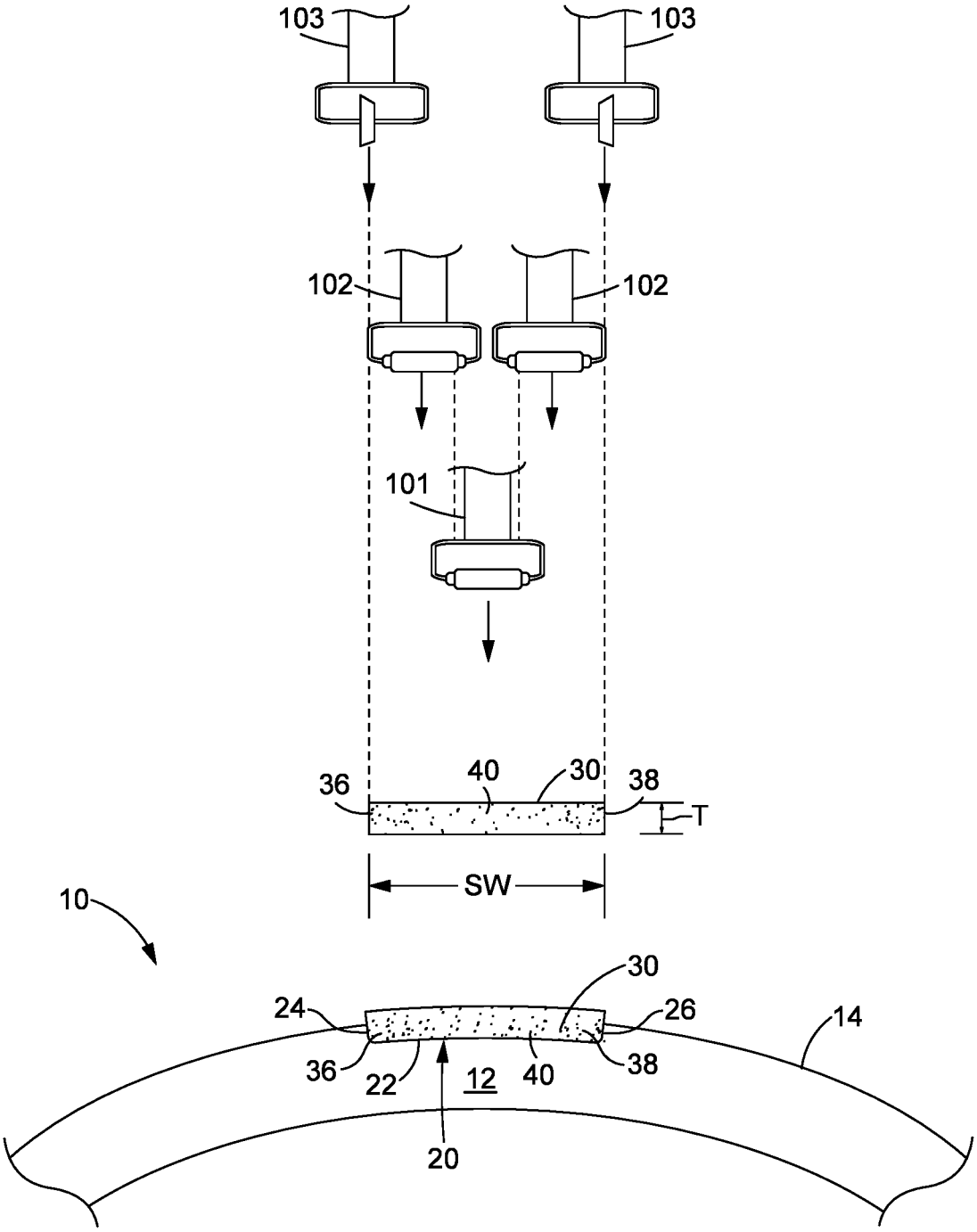
FIG. 13 is a schematic showing an alternative way to make a core.

FIG. 13 is a schematic showing an alternative way to make a core 10. In this alternative, a sequence of rollers 101, 102 and 103 push the strip 30 into the slot 20. A first sequential roller 101 pushes the center region 40 of the strip 30 into the slot 20, where it may be adhered to the bottom wall 22 with glue or other means of adhesion, including but not limited to solvent bonding and heat/melting, that has been previously applied to the slot 20 or to the strip 30. Then a pair of second sequential rollers 102, lined up with the shoulders of the first roller 101, push the portions of the strip 30 on either side of the central portion 40 into place. Finally, an optional third set of sequential "tucking" rollers 103, lines up with the side edges 36, 38 of the strip 30, push or tuck in portions of the strip leading and trailing side edges 36, 38 immediately adjacent the slot's leading and trailing edges 24, 26, where these portions may be adhered to the slot 20.

Figure 14:
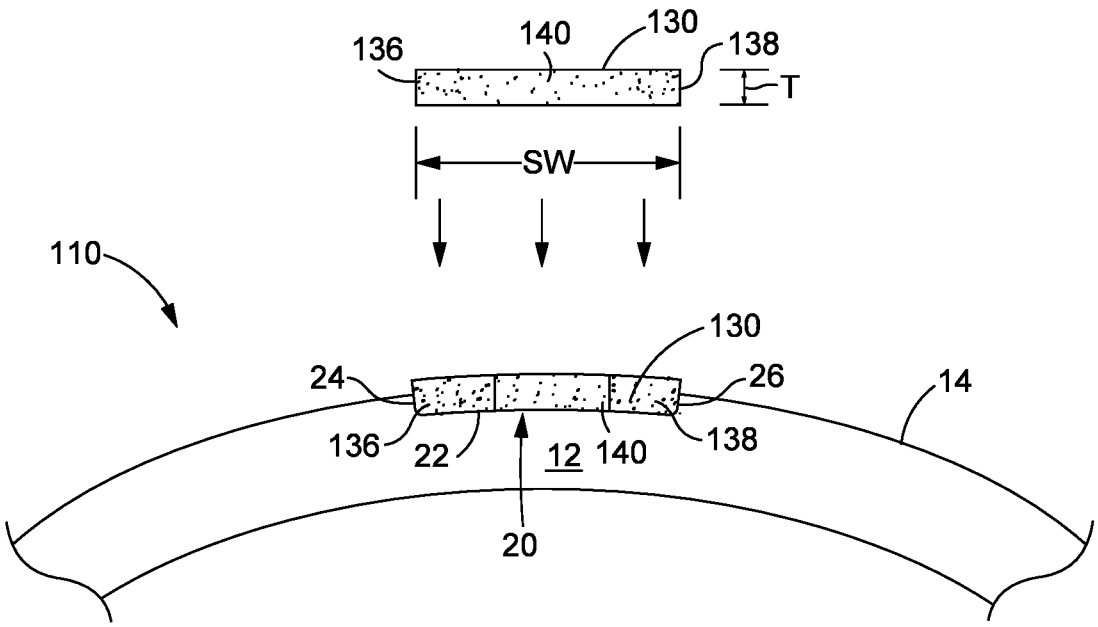
FIG. 14 is a schematic of an alternative core before and after multiple strips have been installed into the slot.

FIG. 14 is a schematic of an alternative core 110 before and after multiple strips 130 have been installed into the slot 20. In this embodiment, the strips 130 are multiple longitudinal strips of different densities, for example, a lower density strip 140 (say, 2 lbs./cu. in.) for installation into the center region of the slot 20 and higher density strips 136, 138 (say, 4 lbs./cu. in.) for installation into the slot 20 adjacent the leading and trailing sidewalls 24, 26.

It is understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A core for winding sheet material thereon, the sheet material having a leading edge, the core comprising:

a cylindrical hollow tube having a length, the tube having an outer facing surface, an inner facing surface and a central longitudinal axis (A), the tube having a first annular end and a second annular end, the tube defining a slot having a bottom wall, a leading sidewall and a trailing sidewall, each sidewall extending from a top edge at the outer facing surface of the tube to a bottom edge, the slot extending the length of the tube substantially parallel to the central longitudinal axis (A), wherein the bottom wall defines a centrally disposed longitudinally oriented dip located between the sidewalls; and a strip of material disposed within the slot, the strip having a length substantially the same as the length of the tube, the strip having a longitudinal leading side edge and a longitudinal trailing side edge, the strip having a strip width (SW) and a strip thickness (T), the strip having a longitudinally oriented central region extending the length of the strip between the leading side edge and the trailing side edge.

2. The core of claim 1 wherein the slot depth is constant everywhere except along the dip.

3. The core of claim 1 wherein the strip is a soft foam or rubber material.

4. The core of claim 1 wherein the strip is not as compressed at the central region than at the leading and trailing side edges.

5. The core of claim 1 wherein the strip is less dense at the central region than at the leading and trailing side edges.

6. The core of claim 1 wherein the bottom wall is annular except at the dip.

7. The core of claim 1 wherein the leading sidewall and the trailing sidewall are parallel.

8. The core of claim 1 wherein the sidewalls taper inward toward each other in a radially inward direction.

9. The core of claim 1 wherein the sidewalls form a dovetail shape.

10. A core for winding sheet material thereon, the sheet material having a leading edge, the core comprising:

a cylindrical hollow tube having a length, the tube having an outer facing surface, an inner facing surface and a central longitudinal axis (A), the tube having a first annular end and a second annular end, the tube defining a slot having a bottom wall, a leading sidewall and a trailing sidewall, each sidewall extending from a top edge at the outer facing surface of the tube to a bottom edge, the slot extending the length of the tube substantially parallel to the central longitudinal axis (A), wherein the outer facing surface has a first radius of curvature and the bottom wall has a radius of curvature greater than the first radius of curvature; and a strip of material disposed within the slot, the strip having a length substantially the same as the length of the tube, the strip having a longitudinal leading side edge and a longitudinal trailing side edge, the strip having a strip width (SW) and a strip thickness (T), the strip having a longitudinally oriented central region extending the length of the strip between the leading side edge and the trailing side edge.

11. The core of claim 10 wherein the slot has a slot width, and the slot depth varies along the entire slot width.

12. The core of claim 10 wherein the strip is a soft foam or rubber material.

13. The core of claim 10 wherein the strip is not as compressed at the central region than at the leading and trailing side edges.

14. The core of claim 10 wherein the strip is less dense at the central region than at the leading and trailing side edges.

15. The core of claim 10 wherein the leading sidewall and the trailing sidewall are parallel.

16. The core of claim 10 wherein the sidewalls taper inward toward each other in a radially inward direction.

17. The core of claim 10, wherein the sidewalls form a dovetail shape.

* * * * *